United States Patent [19]

Nishikiori et al.

[11] Patent Number: 4,545,740

[45] Date of Patent: Oct. 8, 1985

[54] AUTOMATIC OPERATING SYSTEM FOR PUMP DRIVEN BY INTERNAL COMBUSTION ENGINE

[75] Inventors: Kenji Nishikiori; Naomitsu Ozawa, both of Kanagawa, Japan

[73] Assignee: Ebara Corporation, Tokyo, Japan

[21] Appl. No.: 652,576

[22] Filed: Sep. 20, 1984

[51] Int. Cl.[4] ..... F04B 9/00; F04B 17/00

[52] U.S. Cl. ..... 417/317

[58] Field of Search ..... 417/15, 26, 34, 44, 417/316, 317, 279; 169/13

[56] References Cited

U.S. PATENT DOCUMENTS

| | | | |
|---|---|---|---|
| 2,373,143 | 4/1945 | Samiran | 417/34 X |
| 2,651,263 | 9/1953 | Mathews | 417/316 |
| 2,900,915 | 8/1959 | Rowell | 417/34 X |
| 3,040,992 | 6/1962 | Weigand | 417/316 X |
| 3,111,903 | 11/1963 | Waterman | 417/34 |
| 3,147,767 | 9/1964 | Goss | 417/316 X |
| 3,159,965 | 12/1964 | Woolley et al. | 417/34 X |
| 3,335,962 | 8/1967 | Schmidt | 417/316 X |
| 3,446,238 | 5/1969 | Norstrud et al. | 417/44 X |
| 3,786,869 | 1/1974 | McLoughlin | 417/34 X |
| 3,788,769 | 1/1974 | Glass et al. | 417/26 |
| 3,894,811 | 7/1975 | Bergey et al. | 417/34 |
| 4,238,073 | 12/1980 | Liska | 417/34 X |
| 4,435,127 | 3/1984 | Kränzle et al. | 417/26 |

FOREIGN PATENT DOCUMENTS

| | | | |
|---|---|---|---|
| 40595 | 11/1981 | European Pat. Off. | 169/13 |
| 1274402 | 8/1968 | Fed. Rep. of Germany | 417/34 |
| 3019718 | 12/1981 | Fed. Rep. of Germany | 417/316 |
| 1088627 | 9/1954 | France | 417/15 |
| 126584 | 8/1982 | Japan | 417/316 |
| 127871 | 8/1982 | Japan | 417/317 |

*Primary Examiner*—William L. Freeh
*Assistant Examiner*—Paul F. Neils
*Attorney, Agent, or Firm*—Oblon, Fisher, Spivak, McClelland & Maier

[57] ABSTRACT

An automatic operating system for a pump driven by an internal combustion engine is disclosed in which the engine is kept in operation at a low and economical speed automatically disconnecting the pump from the engine when delivery pressure from the pump is not required and connecting the pump automatically when delivery pressure from the pump is required. Such automatic control is effected by a valve block in which a safety valve is incorporated, the movement of the valve body of which is utilized to control the connection and disconnection of the pump, the movement of the valve body being dependent on the pressure in the discharge line of the pump.

3 Claims, 4 Drawing Figures

AUTOMATIC OPERATING SYSTEM FOR PUMP DRIVEN BY INTERNAL COMBUSTION ENGINE

FIELD OF INVENTION

The present invention relates to a system for controlling the operation of a pump driven by an internal combustion engine and more particularly to an automatic operating system including control means for controlling the internal combustion engine driving the pump.

BACKGROUND OF INVENTION

In the case of a pump driven by an internal combustion engine, it is customary to control the drive speed of the engine according to the use condition of the pump. That is, for instance when hydraulic pressure is not required for a load connected to the pump, the discharge line of the pump is usually closed and the operating speed of the engine is kept as low as possible so as to save fuel as well as to reduce the noise of the engine. This is because quick discharge of the pump is usually required after the load is once put into inoperative condition and, thus, the engine is preferably kept driven even if the load is not operating. When the engine is kept driven, the discharged liquid from the pump may be returned to a drain tank or the like through a relief valve, etc. On the other hand, if the load is put into operation with hydraulic pressure, the hydraulic line to the load is fully opened whereby the engine speed is increased to its rated speed to meet the needed hydraulic pressure at the load. Such an automatic operating system for a pump driven by an internal combustion engine is disclosed, for example, in Japanese Utility Model Public Disclosure Nos. 127871/82 and 126584/82, etc.

However, an automatic operating system such as referred to above is provided with a pressure accumulator, a flow switch, an unloader valve, etc. in its discharging line arranged to receive an electric signal from the flow switch by a controller to control the drive speed of the engine. While the system above achieves its object of controlling the operation of the engine in response to the condition of the pump, such a system becomes expensive because it needs multiple instruments such as referred to above as well as an expensive controller and maintenance cost therefore becomes higher. Further, the possibility of failure in the instruments involved also becomes higher. In an apparatus operated under hydraulic pressure such as a high-pressure water washing machine or a hydraulic tester wherein a discharge line is repeatedly opened and closed to achieve the intended operation, it is preferable to keep the apparatus simple because a complex machine is more likely to break down.

SUMMARY OF INVENTION

Accordingly, it is an object of the present invention to provide a system for automatically and reliably controlling the operation of a pump driven by an internal combustion engine according to the loading condition of the pump by simplifying construction of the system. The object above is accomplished according to the present invention. In an embodiment according to the present invention, an internal combustion engine and a pump are coupled with each other through a clutch and the pump is coupled to its load via a discharge line and a valve block. A controller for the engine includes an operating member for increasing and decreasing the rotational speed of the engine and the valve block comprises a pressure responsive member for causing the movement of the operating member to increase the speed of the engine when the discharge line is opened and to decrease the speed of the engine when the discharge line is closed. Thus, if the discharge line is closed, the pressure in the discharge line is momentarily increased. The pressure responsive member in the valve block is arranged to be moved in response to such momentary increase of the pressure in the discharge line so as to cause actuation of the operating member to lower the speed of the engine. The clutch coupling the engine and the pump are selected so that the clutch is disengaged when the engine speed is lowered to a certain level. A centrifugal clutch may be one of the types suitable for such function of the apparatus according to the present invention.

On the other hand, when the discharge line is opened to the load, pressure in the discharge line is nonexistent at the initial stage or may not be so high as the value under normal operation since the clutch is not engaged and, thus, the pump is not driven. Under this condition, the pressure responsive member is caused to actuate the operating member to increase the speed of the engine. When the engine speed reaches a certain level, the clutch is engaged to drive the pump.

By employment of a clutch and provision of the valve block in the discharge line and the pressure responsive member in the block interconnected with the operating member which changes the engine speed, it is possible to achieve the object of the present invention, namely simplification of construction of the apparatus. In practice, the pressure responsive member on the valve block of the present invention is preferably made as a valve body for a safety valve. With such construction, further provision of a safety valve in the discharge line may be eliminated. Also, the closure and opening of the discharge line may be interrelated with the pressure responsive member. The pressure responsive member may further comprise a regulating member to maintain a low engine speed after operation of the load is stopped. The pressure responsive member in the valve block and the operating member are preferably interconnected by an electric means.

The advantages and effect of the present invention will become more clear when the detailed description of the preferred embodiment is reviewed in conjunction with the accompanying drawings, a brief explanation of which is summarized below.

DETAILED DESCRIPTION OF THE PREFERRED EMBODIMENT

Figure 1:
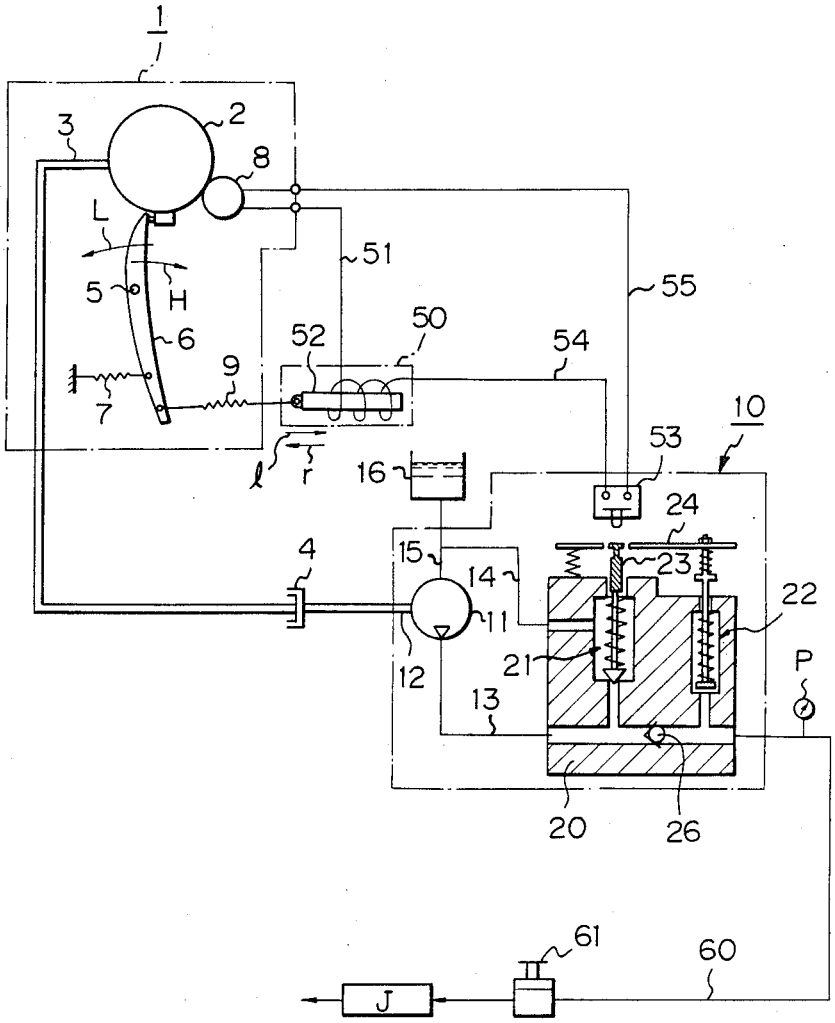
FIG. 1 is a schematic illustration of a system for a cleaner into which the present invention is incorporated.

Referring now to FIG. 1, there is shown an embodiment according to the present invention wherein a load to a pump is illustrated as a high-pressure water cleaner J. An automatic operating apparatus is illustrated comprising two major sections, namely an internal combustion engine assembly 1 and a pump assembly 10, the load i.e. cleaner J being connected to the pump assembly 10 through a discharge line 60.

The engine assembly 1 comprises an internal combustion engine 2 having an output shaft 3. The pump assembly 10 comprises a pump 11 having an input shaft 12. The output shaft 3 of the engine 2 is coupled with the input shaft 12 of the pump through a centrifugal clutch 4. The operating speed of the engine 2, which may be a gasoline engine or a diesel engine, is arranged to be controlled by an operating member or lever 6 such as a throttle lever or an accelerator. In the illustrated embodiment, the lever 6 is pivotably mounted at a pivot 5 and the speed of the engine 2 is increased to a high speed such as a rated switch when the lever 6 is pivoted in the direction "H" and is decreased to a low speed such as an idling speed when the lever 6 is rotated in the direction "L" against the bias of a spring 7. The engine 2 is accompanied by a dynamo 8 adapted to be driven by the engine 2.

The dynamo 8 is connected to an electromagnet 50 and a micro-switch 53 through circuits 51 and 55, respectively, and the electromagnet 50 and the micro-switch 53 are connected through a circuit 54. The electromagnet 50 is arranged to be actuated by an electric current from the dynamo 8 when the micro-switch 53 is on-state, which will be explained later. When the electromagnet 50 is actuated by the current from the dynamo 8, a core 52 of the magnet 50 is attracted in the direction "l" and, when the current is off, the core 52 is moved in the direction "r" by a spring 9.

Next, the pump assembly 10 will be touched upon. The pump assembly 10 includes a valve block 20. A discharge line 13 from the pump 11 is coupled to the discharge line 60 from the pump assembly 10 through the valve block 20, the discharge line 60 being, for example, a flexible hose and connected to the cleaner J through a manual valve 61. P is a pressure gage provided in the discharge line 60. By opening and closing the valve 61, the load J is put into operation or shut down so that the cleaner J is directly controlled by the valve 61. The manual valve 61 is preferably a lever type which may be operated by depressing and/or releasing the lever so that the discharge line 60 is opened upon depression and closed upon release of the lever.

Figure 2:
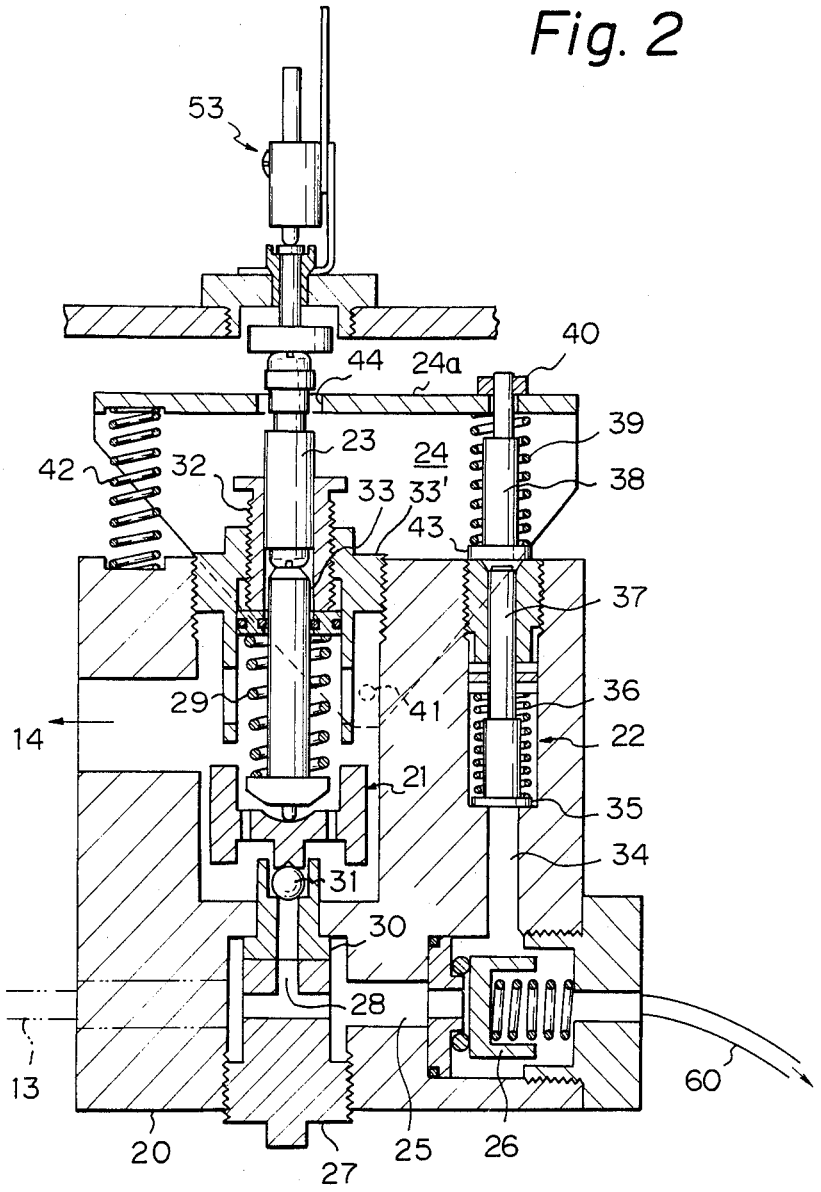
FIG. 2 is a cross sectional view of a valve block employed in the system shown in FIG. 1.

The construction of the valve block 20 is illustrated in FIG. 2 as comprising a high pressure safety valve 21 and a piston arrangement 22. Cleaning liquid or water relieved from the safety valve 21 as a result of a pressure higher than a predetermined value is arranged to be directed to an intake line 14 for the pump 11. A tank 16 is provided upstream of the intake line 14 for reserving cleaning liquid. The discharge line 13 from the pump 11 and the discharge line 60 from the valve block 20 are coupled with each other through a passage 25 formed in the block body and a check valve 26 disposed in the passage 25.

In the valve block body, a further passage 28 diverges from the passage 25 to direct pressure in the passage 25 to the high pressure safety valve 21 which includes a valve seat 20 and a retaining member 27 threadedly mounted in the valve block 20 for retaining the valve seat 30 in place. The retaining member 27 may be screwed in the block body.

At the relief side of the valve seat 30, a valve ball 31 is urged against the seat 30 through a valve body 33 and a spring 29. The spring 29 may be adjusted by a retainer 32 by adjusting its position by means of screw engagement in a retaining member 33 to set a relief pressure of the safety valve. The spring retainer 32 is formed of cylindrical or tubular so that the valve body 33 may be axially guided through the inner bore of the retaining member 32. The retaining member 33' is threadedly mounted in the valve block 20.

A regulating plunger 23 is disposed coaxially with the valve body 33 so that the plunger 23 is moved and also guided by the retaining member 32 together with the valve body 33 when the valve body 33 is moved upwardly against the bias of the spring 29 by high pressure in the passage 28. The reason the plunger 23 is provided independently of the valve body 33 is that the regulating plunger 23 is arranged to be interrelated with the micro-switch 53 so that the micro-switch 53 is contacted by the plunger 23 and such contact is maintained by the plunger 23 even after the valve body 33 is moved to its original position, which will be discussed later.

From a liquid chamber for the check valve 26, a narrow passage 34 extends upwardly to the piston arrangement 22, which includes a piston 35, a rod 37 extending upwardly from the piston 35, and a spring 36 urging the piston 35 downwardly. The rod 37 is coupled with a holder pin 38 having a flange 43 to move the pin 38 upwardly when the rod 37 is moved upwardly by the piston 35 against the bias of the spring 36, this movement being caused by pressure in the discharge line 60. This point will be discussed later.

A pivotable angle plate member 24 pivots about a pivot pin 41 which is supported in the position shown by compressing springs 42 and 39 together with a nut 40 secured at the top of the pin 38 axially coupled with the rod 37 and extending through a horizontal portion **24*a* of the plate member 24. The horizontal portion 24*a* is also provided with a perforation 44 to pass the upper portion of the regulating plunger 23** therethrough.

When the pressure in the discharge line 60 becomes higher than a predetermined value, the piston 35 is urged upwardly thereby moving the rod 37 upwardly. The predetermined value is set by the spring 36. With the upward movement of the rod 37, the holder pin 38 is also moved upwardly and the flange 43 of the pin 38 compresses the spring 39 so that the plate member 24 pivots about the pivot pin 41 compressing the spring 42.

As to the operation of the high pressure safety valve 21, the valve body 33 is moved upwardly when the pressure in the passage 25 rises moving the valve ball 31 upwardly. Upon upward movement of the valve body 33, the regulating plunger 23 is also moved upwardly to contact the micro-switch 53 to put it "on" state so that the electromagnet 50 is energized to attract the core 52 in the direction "l" thereby moving the operating lever 6 in the direction L to lower the speed of the engine 2. The position of the plunger 23 for keeping the micro-switch 53 "on" is maintained by the plate member 24 as explained hereunder.

Figure 3:
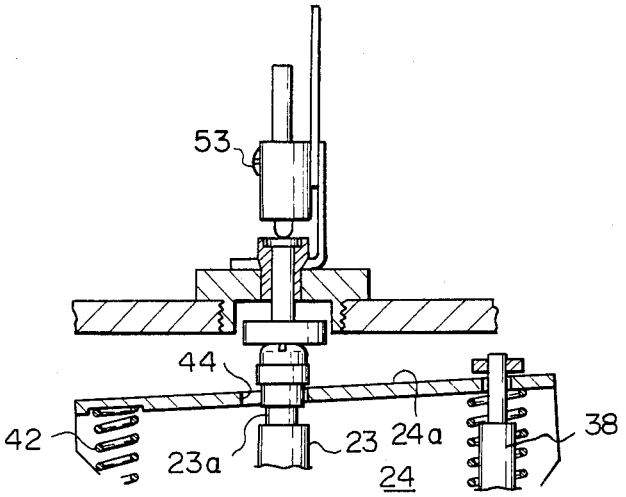
FIG. 3 and FIG. 4 indicate the modes of operation of the valve block.

The status illustrated in FIG. 1 or FIG. 2 corresponds to that in which the discharge line 60 is opened by the manual valve 61 and thus, neither the high pressure safety valve 21 or the piston arrangement 22 is operative. Therefore, the micro-swirch 53 is kept in its "off" state and the electromagnet 50 is denergized, whereby the operating lever 6 is rotated in the direction H to operate the engine 2 at high speed or its rated speed. Since the engine 2 is driven at high speed, the centrifugal clutch 4 is engaged and thus, the pump 11 is driven at its rated speed to have the cleaner J perform its intended job with the pressurized liquid. With the flowing of the pressurized liquid in the discharge line 60, the piston 35 in the arrangement 22 is moved upwardly as illustrated in FIG. 3. Such movement of the piston 35 is appropriately set by adjustment of the spring 36. However, the safety valve 21 is not operated under such normal operation of the load J whereby the micro-switch 53 is kept in its "off" state.

When the manual valve 61 is released to close the discharge line 60 to stop the operation of the cleaner J, the pressure in the discharge line 60 is momentarily raised so that the check valve 26 stops the flow from the line 13 to the line 60 whereby the valve ball 31 and the valve body 33 are raised by the pressure in the passages 25 and 28 and the relieved liquid is directed to the line 14.

Figure 4:
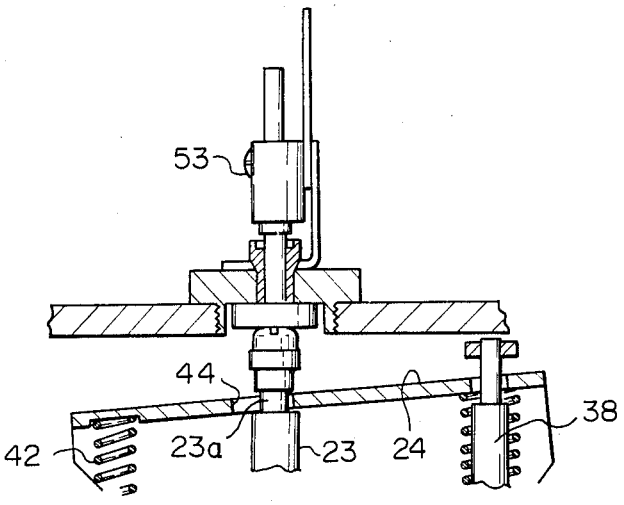

At this time, the regulating plunger 23 is also moved upwardly to contact the micro-switch 53 as shown in FIG. 4 and further upward movement of the plunger 23 puts the micro-switch 53 in its "on" state as shown in FIG. 4 whereby the engine speed is lowered as explained hereinbefore. Accordingly, the clutch 4 is disengaged and the valve body 33 is reinstated in its original position shown in FIG. 2; however, the regulating plunger 23 is held by the angle plate member 24 in the position shown in FIG. 4 to keep the micro-switch 53 in its "on" state. The reason for this is that, when the angle plate 24 is moved to the position shown in FIG. 3 by the upward movement of the piston 35 upon sensing the delivery pressure in the line 60, the perforation 44 in the horizontal portion 24*a* of the angle plate member 24 is engaged with the regulating plunger 23 due to the canted position of the horizontal portion 24*a* as shown in FIG. 3. Thus, the perforation 44 is prepared to further engage a smallest neck portion 23*a* of the plunger 23 to instantly arrest it in the position shown in FIG. 4 when the plunger 23 is fully moved upwardly. Thus, even if the valve body 33 is reinstated to its original position shown in FIG. 2, the plunger 23 is maintained in position to keep the micro-switch 53 in an "on" state by the engagement of the perforation 44 with the neck portion 23*a* of the plunger 23. The pressure in the passage 34 is maintained between the check valve 26 and the manual valve 61 and thus, the piston 35 is held in position to keep the pin 38 as illustrated in FIG. 4 whereby the canted position of the horizontal portion 24*a* is kept to continue the engagement between the neck portion 23*a* and the perforation 44 and the engine speed is kept low with the clutch 4 disconnected.

In the situation above, if it is desired to operate the cleaner J, the handle lever for the manual valve is depressed to open the discharge line 60 so that the pressure in the passage 34 is decreased, thus permitting the piston 35 to move downwardly under the bias of the spring 36 and the horizontal portion 24*a* of the clamping plate member 24 to be restored to its horizontal position shown in FIG. 2 by the spring 42 so as to disengage the perforation 44 from the neck portion 23*a*. Therefore, the regulating plunger 23 is also permitted to move downwardly under the force of gravity so as to release the micro-switch 53, putting it in its "off" state so that the core 52 is moved in the direction "r" to cause movement of the operating lever 6 in the direction H. Thus, the engine speed is increased and the clutch 4 is engaged so as to drive the pump 11.

As explained in detail hereinabove, the movement of the valve body of the safety valve in the high pressure line is transmitted through the micro-switch to the operating lever in order to change the speed of the engine. The whole system is kept compact because such a safety valve is customarily provided in the pressure line. Also, according to the present invention, when operation of the load is not required, the engine is kept at low speed; moreover, commencement and stoppage of operation automatically effect a change of speed in the engine; thus, loss of power is minimized and operating costs are greatly reduced.

While the present invention has been explained in detail referring to the particular embodiment, it should be noted that the present invention is not limited to that explained and may be easily modified or changed by those skilled in the art within the spirit and scope of the present invention, which is defined in the claims appended hereto.

What is claimed is:

1. An automatic operating system for a pump driven by an internal combustion engine, said automatic operating system comprising:

(a) an engine assembly including said engine associated with an operating member for varying the rotational speed of said engine;

(b) a pump assembly including said pump and a valve block hydraulically coupled with each other through a discharge passage from said pump, said valve block including a safety valve acting on said discharge line;

(c) a centrifugal clutch which couples an output shaft of said engine to an input shaft to said pump;

(d) a discharge line lead from said valve block to a load to which hydraulically pressurized liquid is supplied therethrough; and (e) a valve disposed in said discharge line and adapted to close and open said discharge line;

(f) said valve block including a pressure responsive valve body in said safety valve and a regulating plunger adapted to move together with said pressure responsive valve body to contact a micro-switch when said valve in said discharge line is closed, the contact putting the microswitch in its "on" state, which causes said operating member to move to lower the engine speed to disconnect said clutch; and (g) an arresting member arresting said plunger in a position to maintain said microswitch in its "on" state even when said valve body is returned to a position to close said safety valve until the valve in the discharge line is opened.

2. A system as claimed in claim 1 wherein, when said valve in said discharge line is opened, said regulating plunger is released from said arresting member to change said "on" state to an "off" state, which causes movement of said operating member so as to increase the rotational speed of said engine and engage said clutch.

3. A system as claimed in claim 1 wherein said arresting member is displaced to a position to arrest said regulating plunger in said position for maintaining said "on" state, the displacement of said arresting member being effected by the pressure in said discharge line.

* * * * *